US005348053A

United States Patent [19]

Oertli

[11] Patent Number: 5,348,053

[45] Date of Patent: Sep. 20, 1994

[54] DEVICE FOR COUPLING AND UNCOUPLING HEALD SHAFTS

[75] Inventor: Gustav Oertli, Brütten, Switzerland

[73] Assignee: Sulzer Rueti AG, Rueti, Switzerland

[21] Appl. No.: 116,142

[22] Filed: Sep. 2, 1993

[30] Foreign Application Priority Data

Nov. 13, 1992 [EP] European Pat. Off. ..... 92810884.4

[51] Int. Cl.[5] ..... D03C 9/00; D03C 1/14

[52] U.S. Cl. ..... 139/57

[58] Field of Search ..... 139/57, 30, 58, 78

[56] References Cited

U.S. PATENT DOCUMENTS 3,169,555 2/1965 Koyder .

3,888,284 6/1975 Tiernan et al. ..... 139/57 X 4,369,815 1/1983 Gehring et al. ..... 139/57

*Primary Examiner*—Andrew M. Falik

[57] ABSTRACT

An apparatus and method for coupling and uncoupling a plurality of heald shafts (31) to and from their corresponding shaft rods (2) in a shaft drive. Male and female coupling parts (3, 5) are connected to each heald shaft and shaft rod, respectively, and a locking element 4 is pivotally mounted within the female coupling part to lock these parts together. Two drive units (7, 8) pivot two U-shaped shackles (9, 10) from an open position into a closed position. This movement unlocks each locking element so that each male coupling part and heald shaft can be vertically removed from its female coupling part. At the same time, the shackles secure each female coupling part so that they will remain in position to receive the next heald shaft.

9 Claims, 2 Drawing Sheets

DEVICE FOR COUPLING AND UNCOUPLING HEALD SHAFTS

BACKGROUND OF THE INVENTION

The present invention relates to a device for coupling and uncoupling heald shafts to and respectively from a heald shaft drive having several shaft rods. The device includes a coupling part on the side of the shaft and a coupling part on the side of the shaft rods, a locking element which locks the coupling parts and a swivelling operating mechanism for the locking element.

In EP-A-407 334 is described an operating tool, in which members, which are disposed parallel to one another and swivel around a common axis of rotation, open the couplings and shaft rod, the coupling parts being retained in such a manner that the heald shaft can be automatically exchanged via a vertical movement. With this operating tool the fact that the heald shafts have varying levels because of the preparation of the warp is not taken into consideration, and this is a disadvantage.

SUMMARY OF THE INVENTION

The object of the invention is to create a device of the aforementioned type, which aligns the coupling parts during the coupling and uncoupling operations and keeps them positionally stable, so that a safe locking function is guaranteed.

The advantages which can be achieved with the invention are that the device takes into consideration the small amount of available space beneath the heald shafts and only becomes evident when the heald shafts are exchanged.

For the loom, there is the advantage that the shaft changing operation can be automatically performed by the control mechanism or be performed by means of a remote-controlled device.

BRIEF DESCRIPTION OF THE DRAWINGS

The invention is explained below by means of the attached drawings.

DESCRIPTION OF THE PREFERRED EMBODIMENT

Figure 1:
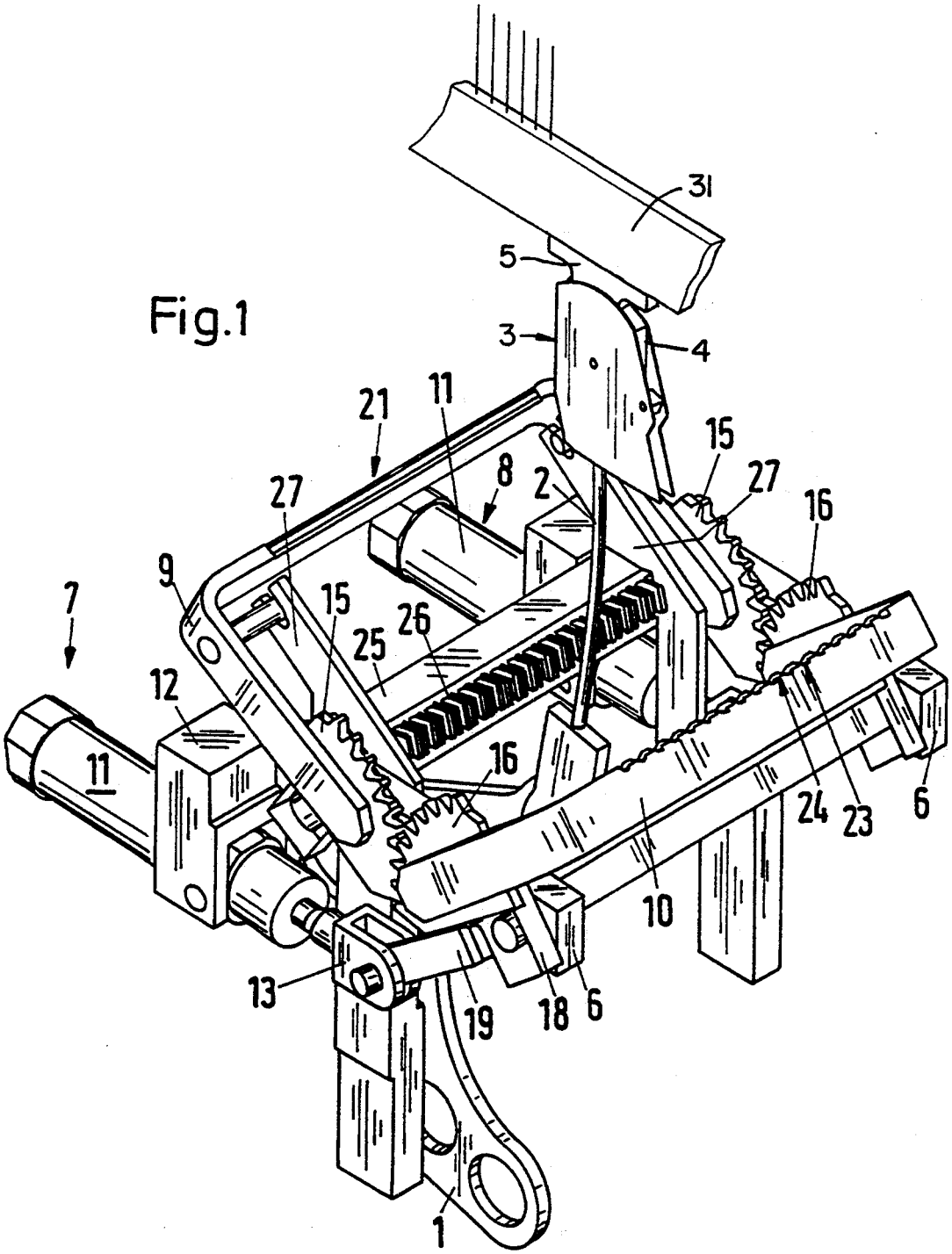
FIG. 1 shows a three-dimensional view of an exemplified embodiment of a device in accordance with the invention in the inoperative position and FIG. 2 shows a three-dimensional view of the device as shown in FIG. 1 in the operational position.
Figure 2:
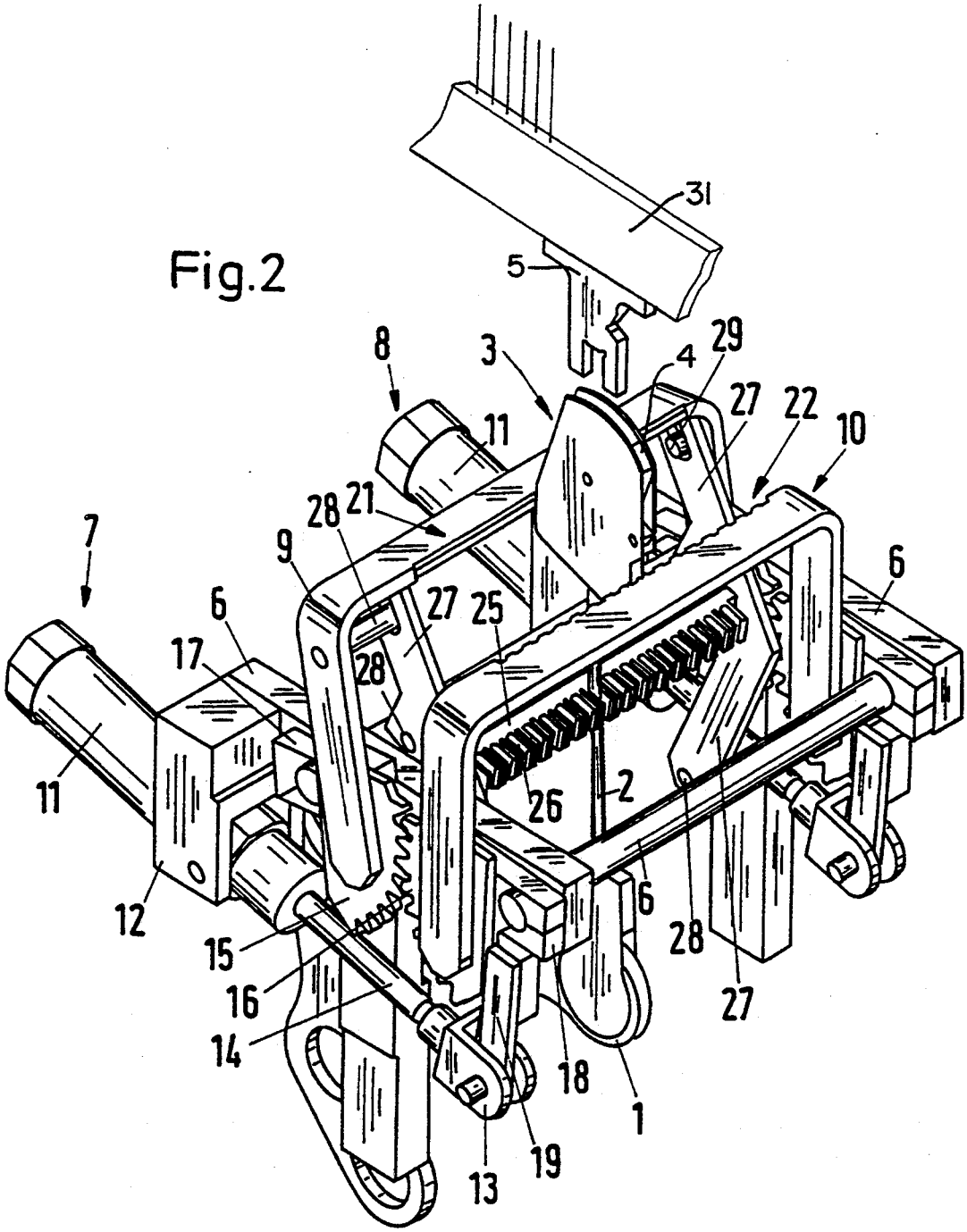

FIGS. 1 and 2 show the device together with a part of the shaft drive, which comprises an angle lever 1 and a shaft rod 2, which is coupled to the angle lever 1 and connected to a female coupling part 3 with a locking element 4 in a rigid manner with respect to compression and tension.

A male coupling part 5, which is attached to a heald shaft 31, is also represented.

In a frame 6, which is mounted on the frame of a loom (not shown), are disposed a drive arrangement having two drive units 7, 8 with an identical construction and two U-shaped shackles 9, 10, which act as stabilizing members and can swivel in opposite directions to one another around axes of rotation extending parallel to one another.

Each drive unit 7, 8 contains a linear motor 11, which is swivel-mounted in a support 12 attached to the frame 6, a fork 13, which is attached to the connecting rod 14, and gear means in the form of two toothed quadrants 15, 16, which are connected in a rotationally secure manner to the shackles 9, 10 and rotatably disposed by means of retaining members 17, 18 on the frame 6, so that the toothed quadrants 15, 16 mesh with one another. For this reason, only one toothed quadrant 15 has to be connected to the linear motor 11, which in the present case is performed by means of a lever 19, which is connected rotatably to the fork 13 and in a rotationally secure manner to the retaining member 17.

As can be seen from FIG. 2 in particular, at the opposite edges of their base sections the shackles 9, 10 each comprise a section 21, 22 for housing the female coupling part 3 and respectively for operating the locking element 4. For this purpose at the base section the section 22 is provided with a row of tooth-like projections 24 for unlocking the locking element. The projections are limited by the recesses 23 in which the female coupling part 3 is disposed and laterally secured if the device is closed for the purpose of a shedding motion.

The device also comprises a support 25 for the shaft rods 2. This support 25 contains a plurality of grooves 26, into which the shaft rods 2 can be inserted. The support 25 is attached to two levers 27 and is rotatably disposed on the frame 6 by means of a bolt 28 and is guided on the shackle 9 in carriers 29.

The grooves 26 provided in the support 25 to house the shaft rods 2 are limited by elastically deformable wall sections, which on the opening side are provided with sections so that the slot opening width is smaller that the slot width. Each groove 26 is designed so that the shaft rod 2 can move inside the groove 26, but the shaft rod 2 is prevented from falling out of said groove.

In normal loom operation the device described above is located in an inoperative position (FIG. 1). In this position, the device is secured against unintentional operation, e.g. by mechanically locking the drive arrangement and/or electrically locking the control mechanism.

In order to change the heald shafts, after a textile preparation, e.g. to release fabric and warp residue etc., the loom is moved into a shed closing position, in which the shaft rods 2 assume the position shown in FIG. 2, and said loom is locked in said shed closing position.

Then the drive arrangement 7, 8 is brought into action, as a result of which the shackles 9, 10 are swivelled in opposite directions towards one another and towards the shaft rods 2. The locking element 4 is operated by the shackles 9, 10 and the female coupling part 3 is aligned so that in the on position of the shackles 9, 10 the coupling parts 3, 5 are no longer locked and the coupling parts 3, 4 are kept in a stable position such that the heald shafts may be taken out in a vertical direction (see FIG. 2).

The female part 25 is swivelled with the swivel movement of the shackles 9, 10. As a result the shaft rods 2 are inserted into the grooves 26 and retained there.

After the end of the shedding motion, the device is brought into the inoperative position, whereby the shaft rods 2 not coupled to heald shafts are brought by the female part 25 into a parking position, in which the parked shaft rods 2 move up and down within the grooves 26 of the female part 25 during normal loom operation.

It is possible for the shaft rods to be transferred manually into the parking position instead of automatically. For this purpose the female part 25 can be attached to the frame 6. The previously described device may have a more simple design after the removal of the components required for automatic parking.

I claim:

1. In a heald shaft drive a device for coupling and uncoupling heald shafts associated with a plurality of shaft rods to and from a shaft drive, the device including a first coupling part adapted to be connected to each heald shaft, a second coupling part adapted to be connected to each shaft rod and a locking element mounted to one of the coupling parts for locking said coupling parts together, wherein the improvement comprises:

first and second pivotally mounted stabilizing members, the stabilizing members being configured to move between an open position and a closed position, the stabilizing members unlocking each locking element and maintaining each second coupling part positionally stable when moved into the closed position;

a drive coupled to the first and second members for moving the members in opposite directions with respect to each other between the open and closed position; and the stabilizing members having a plurality of recesses for receiving each second coupling part.

2. In a heald shaft drive a device for coupling and uncoupling heald shafts associated with a plurality of shaft rods to and from a shaft drive, the device including a first coupling part adapted to be connected to each heald shaft, a second coupling part adapted to be connected to each shaft rod and a locking element mounted to one of the coupling parts for locking said coupling parts together, wherein the improvement comprises:

first and second pivotally mounted stabilizing members, the stabilizing members being configured to move between an open position and a closed position, the stabilizing members unlocking each locking element and maintaining each second coupling part positionally stable when moved into the closed position;

a drive coupled to the first and second members for moving the members in opposite directions with respect to each other between the open and closed position; and a female part adapted to be movably coupled to the shaft rods, the female part having a plurality of slot-shaped recesses for movably retaining the shaft rods.

3. A device according to claim 2 including means for movably supporting the female part within the device.

4. A device according to claim 3 wherein one of the first and second stabilizing members is operatively connected with the female part so that the female part moves when the stabilizing members move between the open and closed positions.

5. In a heald shaft drive a device for coupling and uncoupling heald shafts associated with a plurality of shaft rods to and from a shaft drive, the device including a first coupling part adapted to be connected to each heald shaft, a second coupling part adapted to be connected to each shaft rod and a locking element mounted to one of the coupling parts for locking said coupling parts together, wherein the improvement comprises:

first and second movably mounted stabilizing members, the stabilizing members being configured to move between an open positionally stable when moved into the closed position; and a drive coupled to the first and second members for moving the members in opposite directions with respect to each other between the open and closed positions.

6. A device according to claim 5 wherein the drive comprises at least one power source.

7. A device according to claim 6 wherein the drive comprises at least one gear coupled between the power source and the stabilizing members for pivoting the stabilizing members between the open position, in which the members are not in contact with the second coupling part and the locking element, and the closed position, in which the locking element is actuated and the second coupling part is retained.

8. A loom having heald shafts, a shaft drive with a plurality of shaft rods and a device for coupling and uncoupling the heald shafts to and from the shaft rods, the device comprising:

a first coupling part connected to each heald shaft;

a second coupling part connected to each shaft rod;

a locking element mounted to one of the coupling parts for locking the coupling parts together;

first and second movably mounted stabilizing members, the stabilizing members being configured to move between an open position and a closed position, the stabilizing members including means for unlocking each locking element and maintaining each second coupling part positionally stable when moved into the closed position;

a drive coupled to the first and second stabilizing members for moving the members between the open and closed positions; and the coupling parts being positioned beneath the heald shafts so that each heald shaft and corresponding first coupling part is vertically removable from each second coupling part and locking element, the second coupling part being held positionally stable when the heald shaft is removed.

9. A method for uncoupling a heald shaft from a shaft rod in a shaft drive, the heald shaft being coupled to the shaft rod by first and second coupling parts that are locked together by a locking element, the method comprising the steps of:

moving first and second stabilizing members from an open position to a closed position with a drive;

with the stabilizing members in said closed position, unlocking the locking element with one of the stabilizing members and simultaneously securing the second coupling part in a fixed position; and decoupling the first coupling part and the heald shaft from the second coupling part and the locking element.

* * * * *